United States Patent [19]

Gerard, Sr.

[11] 4,253,607

[45] Mar. 3, 1981

[54] ADJUSTABLE SPRAY RACK

[76] Inventor: Melvin J. Gerard, Sr., 2430 Kaiser Rd., Pinconning, Mich. 48650

[21] Appl. No.: 70,045

[22] Filed: Aug. 27, 1979

[51] Int. Cl.[3] ..... B05B 3/18; C10B 39/04

[52] U.S. Cl. ..... 239/185; 141/279; 187/95

[58] Field of Search ..... 141/284, 387, 279; 187/11, 27, 95; 202/227, 253, 95; 55/385 R; 239/159, 164, 165, 176, 178, 184–189

[56] References Cited

U.S. PATENT DOCUMENTS

| | | | |
|---|---|---|---|
| 2,754,227 | 7/1956 | Ransburg | 239/186 X |
| 3,957,137 | 5/1976 | Vermette | 187/11 |

FOREIGN PATENT DOCUMENTS

| | | | |
|---|---|---|---|
| 873686 | 4/1953 | Fed. Rep. of Germany | 202/227 |

*Primary Examiner*—Andres Kashnikow

*Attorney, Agent, or Firm*—Clarence A. O'Brien; Harvey B. Jacobson

[57] ABSTRACT

An adjustable spray rack comprises a winch driven movable carriage mounted on a fixed support post, the carriage having a spray head provided with a pair of downwardly directed spray nozzles separated by a predetermined critical distance, the spray nozzles permitting spray into a load, such as can be carried in an open top truck. Spray of the load, such as rock salt, or the like, can be achieved by the truck load or bucket load, with control of the vertical distance of the spray heads over the load permitting increase or decrease of the pattern of spray in order to accommodate varying sizes of truck boxes.

7 Claims, 4 Drawing Figures

ADJUSTABLE SPRAY RACK

BACKGROUND OF THE INVENTION

Field of the Invention

The invention relates to transport equipment accessories, specifically to spray equipment used in wetting the loads carried in an open top truck. The spray rack is adjustable in height vertically to enable regulation of the pattern of spray to accommodate varying sizes of truck boxes.

Disclosure Statement

In U.S. Pat. No. 838,972, issued Dec. 18, 1906, to L. T. Foreman, a bracket is disclosed for swinging a hose in a circle, but no lifting function of the bracket is disclosed, nor is there disclosed a plurality of discharge nozzles in spaced relation. In U.S. Pat. No. 2,857,201, issued Oct. 21, 1958, to J. E. Palmer, a pivotable device is disclosed for directing spray nozzles in vertical and horizontal planes, particularly for use in spraying cattle. A provision for lifting the entire apparatus by raising the supporting stem is present, but the device is for use with a tractor and fails to disclose a duality or plurality of separated spray nozzles. U.S. Pat. No. 3,961,752, issued June 8, 1976, to G. Doeksen, discloses a plurality of groups of nozzles for wetting particulate material in a bin, gondola car, or the like. While the jets formed by the nozzles are located in spaced relation to each other, they extend radially outwardly along a header, rather than being disposed at an equal distance from the pivot axis. Accordingly, use of the spray means with a conventional load in a truck box is difficult or not possible with the devices of these patents. Further, vertical adjustment cannot be easily controlled by these devices.

In U.S. Pat. No. 1,073,852, issued Sept. 23, 1913, to F. G. Hayes, a tree sprayer is disclosed whose cooperative use with a truck load would be quite difficult or unsuitable, particularly in that the tree sprayer is mobile, while the object of use is fixed, unlike a device fixed in position which is adapted for spraying a movable object.

SUMMARY OF THE INVENTION

The invention provides a spray rack having vertical adjusting capability in the form of a winch driven movable carriage mounted around a fixed support post. Further, a pair of spray nozzles separated by a fixed distance forms a spray head particularly adapted for spraying a load carried in an open top transport vehicle, such as a truck.

Accordingly, a primary object of the invention is to provide a spray rack fixed in position but having a vertically adjustable support arm for controlling the level of a spray head.

Another object of the invention is to provide a spray rack for use with an open top loaded transport vehicle, such as a truck filled with rock salt, whereby substantially even distribution of spray throughout the load carried by the truck can be assured.

Still another object is to provide a duality or plurality of separated spray nozzles aligned to provide for even distribution of spray downwardly on a load carried in the truck.

Yet another object is to provide a winch driven mobile carriage mount for adjusting the height of spray nozzles supported on the carriage.

A further object is to provide a spray device for spraying a load carried in an open truck which can be used to accommodate varying sizes of truck boxes.

Another further object is to provide a spray device for wetting rock salt carried as a truck load or bucket load.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
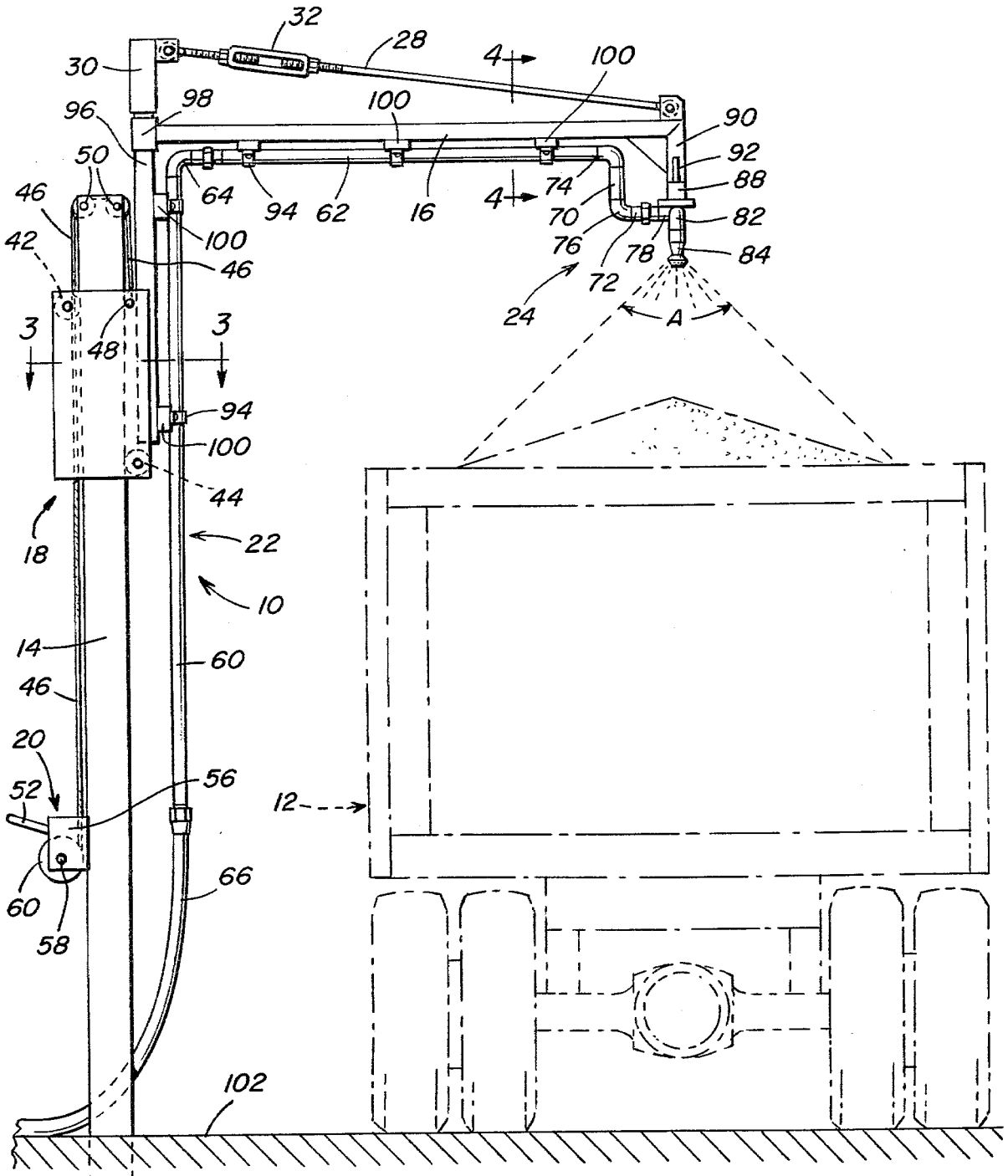
FIG. 1 is a side elevational view of the adjustable spray device of the present invention, positioned for spraying a truck carrying a load of rock salt, the truck being shown in phantom.

In FIG. 1, the adjustable spray device of the present invention is designated generally by the numeral 10, and a transport vehicle bearing a load of rock salt is shown in phantom, designated by the numeral 12. Spray device 10 is composed of fixed vertical support post 14, horizontal support beam 16, movable carriage 18, mounted for vertical movement along post 14, winch mechanism 20, for moving carriage 18 along post 14, fluid supply line 22, and spray head 24 supported at the end of beam 16 for directing a spray upon the load contained in truck 12. Support beam 16 is braced by support rod 28 which is attached to cap 30 and to the end of support beam 16, with adjustment of the length of support rod 28 occurring through turn buckle 32, having stud and eye ends.

Figure 3:
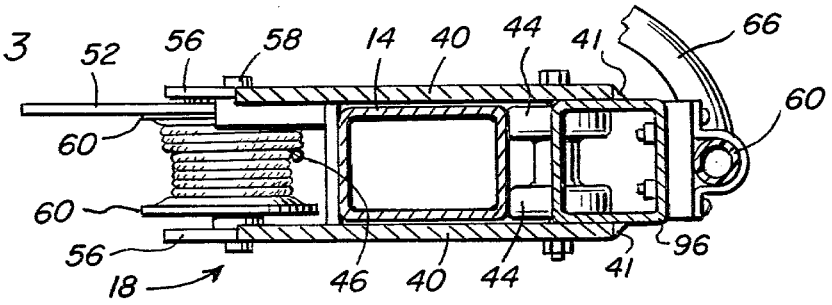
FIG. 3 is a sectional view of the support post and movable carriage, viewed in a downward direction, taken substantially upon a plane passing along section line 3—3 on FIG. 1.

The mechanism for raising and lowering the spray means is best seen in FIG. 1 and in FIG. 3. Movable carriage 18 is made from a pair of side panels 40. Roller wheels 42 and roller wheels 44, each of which are arranged in pairs ride on opposite sides of support post 14 to guide movable carriage 18 vertically along post 14. A winch cable 46 is attached to pin 48, extending between and retained by suitable retaining means in side plates 40. Cable 46 extends over a pair of pulleys 50 mounted atop support post 14. Cable 46 then passes between side plates 40 downwardly along the outside surface of support post 14 to winch mechanism 20 operated manually by handle 52 and suitable conventional ratchet means (not shown). Winch 20 comprises housing 56, support rod 58, and guide plates 60. Housing 56 is attached to support post 14, such as by welding, or the like.

Figure 4:
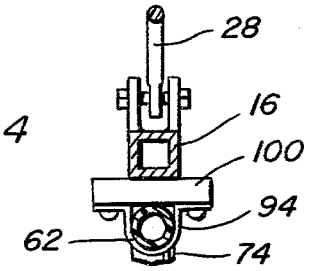
FIG. 4 is a transverse sectional view of the horizontal support beam and associated components, for directing the spray nozzles over the load to be sprayed, taken substantially upon a plane passing along section line 4—4 on FIG. 1.
Figure 2:
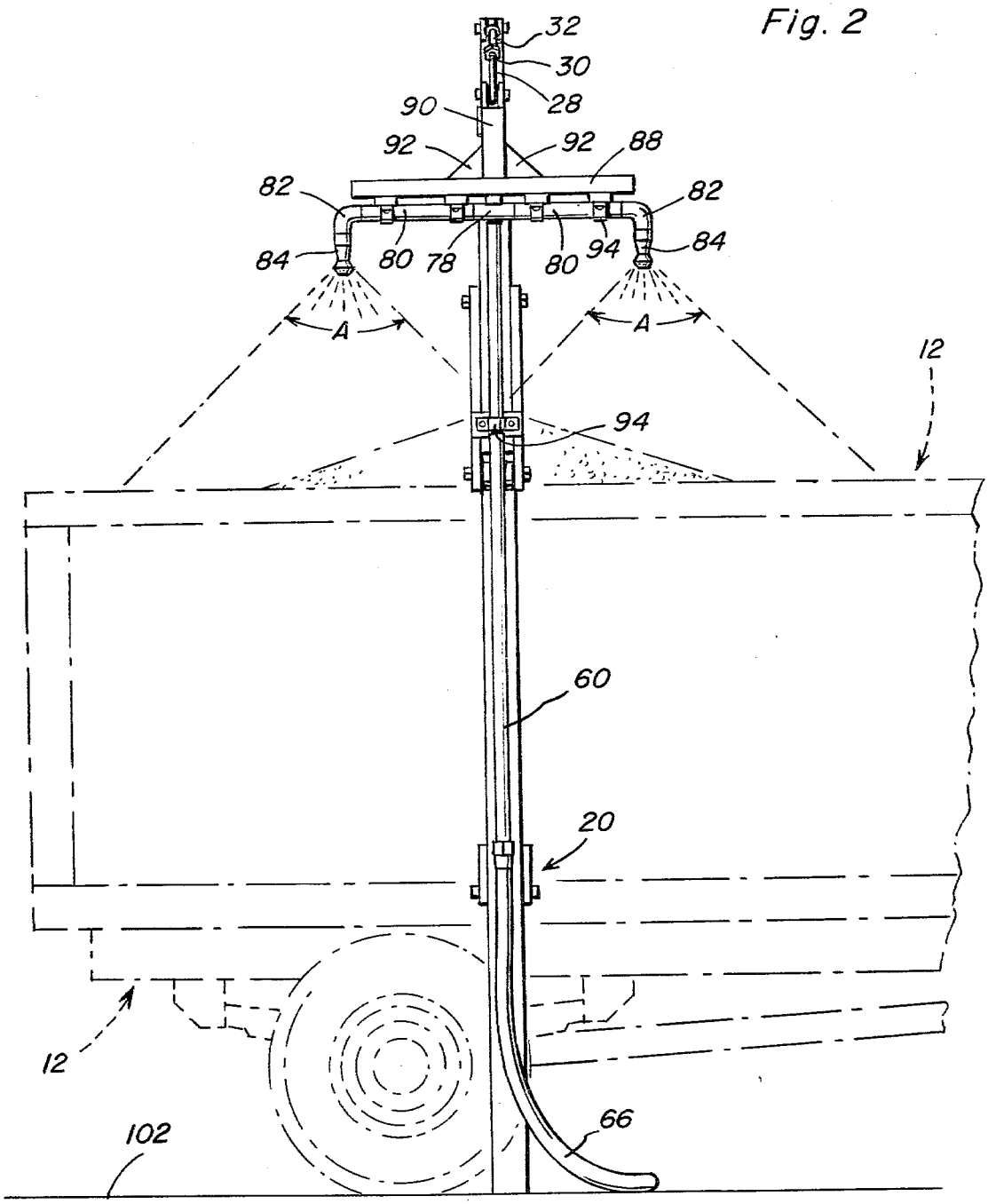
FIG. 2 is a side elevational view of the same arrangement as FIG. 1, viewed in the direction of the support beam, the truck also being shown in phantom.

Supply pipe 22 comprises vertical section 60, horizontal elevated section 62, elbow 64, joining sections 60 and 62 and flexible hose 66, attached at the lower extension of vertical portion 60 and communicating with a fluid supply (not shown). Spray head 24 consists of transition segments 70 and 72, joined to a pipe section 62 by appropriate elbows 74 and 76, and leading to pipe tee 78 for connection to spray head arms 80. Arms 80 communicate with spray nozzles 84 via connecting spray elbows 82. Nozzles 84 are directed at the load placed in truck 12 and are separated by horizontal distance appropriate to the character of the load carried by truck 12 and determined, at least in part, by the angle of divergence of spray from nozzles 84, the angle being represented by the letter A in FIG. 2 and in FIG. 1. Pipe 22 is supported in the region of spray head 24 by cross bar 88, dependingly supported from support beam 16 by segment 90. Bar 88 receives additional support by gussets 92. Pipe 22 is held by a plurality of suitable brackets 94 to cross bar 88, as well as to support beam 16 and to support tubing 96 movable with movable carriage 18. Support beam 16 is attached to support tubing 96 by sleeve 98, permitting free rotation of support beam 16 and associated spray head 24 about support tubing 96, thereby enabling spray head 24 to be swung through an arc and retracted when not in use. Each one of brackets 94 is mounted on bracket mount 100, as best seen in FIG. 4. Spray head 24 is adjusted vertically over truck 12 by movement of movable carriage 18 upward or downward along post 14. As can be seen in FIGS. 1 and 3, support tubing 96, having supported thereon horizontal beam 16 and associated spray nozzles 84, is attached to plates 40 by means of weldments 41, and thus is movable with movable carriage 18 as winch cable 46 is moved.

Although spraying of various loads and of various configurations is possible with the present invention, it is particularly suitable for spraying a load of rock salt by the truck load or bucket load. By raising or lowering support beam 16 by means of movable carriage 18, the pattern of spray emerging from nozzles 84 can be increased or decreased, and device 10 thereby can be used to accommodate varying sizes of truck boxes. In a preferable construction, nozzles 84 are separated by a distance of about 46 inches, and nozzles 84 have a maximum lift height of 13 feet from ground level, represented by reference numeral 102. A maximum load height of 6 feet 6 inches can then be obtained. If desired, a column stop (not shown) can be attached to support post 14, in order to limit the maximum lowered height, such as to a height of about 10 feet.

Winch mechanism 20 can be a conventional winch, such as that manufactured by Fulton Mfg. Company, Milwaukee, Wisc. Nozzles 84 are preferably full jet spray heads, such as manufactured by Spraying Systems Co., Wheaton, Ill.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An adjustable spray device for spraying downwardly into an open top receptable, the device comprising a vertical fixed support post, a movable carriage means mounted on said post, and liquid spray means, the liquid spray means being mounted on the movable carriage means for vertical movement along the length of the support post, said spray device further including a winch assembly, and a connecting cable attached to the movable carriage means and adapted for drawing and releasing by the winch assembly to raise and lower the movable carriage means on the support post, the winch assembly being fixedly attached to the support post, the movable carriage means comprising a carriage assembly including a pair of parallel side plates straddling the support post, the connecting cable being attached to the carriage assembly by a holding means joined to the parallel side plates, said cable being attached to the holding means at the end remote from the winch means, the carriage assembly having a pair of roller wheels journalled there into, the roller wheels being adapted for guiding the carriage assembly on the support post, the connecting cable extending upwardly from the holding means to pulley means located at the upper extremity of the support post and passing thereover to the winch means, said side plates being attached to a support pipe projecting upwardly, said support pipe being movable with said carriage assembly and supporting a support beam projecting horizontally outwardly therefrom, the support beam supporting the liquid spray means.

2. The spray device of claim 1 wherein said liquid spray means includes a pair of spray nozzles separated by a predetermined distance for directing spray downwardly, said nozzles being mounted at substantially identical elevations above a ground surface.

3. The spray device of claim 2 wherein said predetermined distance is about 46 inches.

4. The spray device of claim 3 wherein said support beam is additionally reinforced by a tension member extending from the outward extremity of the support beam to the upward extremity of the support pipe, the support beam having a support segment dependingly attached to the outward extremity thereof for support of the liquid spray means.

5. The spray device of claim 4 wherein said liquid spray means includes liquid supply means comprising a flexible supply tube, a rigid supply pipe connected to the supply tube, and a spray head means connected to the supply tube opposite the flexible supply pipe, the rigid pipe and spray head means being attached by a plurality of brackets to said movable carriage means.

6. The spray device of claim 5 wherein said rigid supply pipe is connected to said spray head means by an elbow, and wherein said spray head means comprises a transition segment connected to a pipe tee, said tee feeding lateral segments extending substantially horizontally in a direction substantially perpendicular to said support beam and said support post, said lateral segments terminating in elbows to which said spray nozzles are attached for directing said spray downwardly.

7. The spray device of claim 6 wherein said lateral segments are supported by a cross bar attached to said support segment and reinforced by a pair of gussets connecting the support segment and cross bar, said cross bar supporting said terminal segments by brackets, said brackets being attached to support blocks unitary with said cross bar.

* * * * *

UNITED STATES PATENT AND TRADEMARK OFFICE

CERTIFICATE OF CORRECTION

PATENT NO. : 4,253,607

DATED : March 3, 1981

INVENTOR(S) : Melvin J. Gerard, Sr.

It is certified that error appears in the above—identified patent and that said Letters Patent is hereby corrected as shown below:

Column 3, line 62, delete "receptable", insert --receptacle--.

Column 4, line 15, delete "there into", insert --thereinto--.

Column 4, line 25, after "means", insert --, whereby the pattern of spray directable vertically downwardly can be increased or decreased as the movable carriage means is raised or lowered, respectively--.

Signed and Sealed this

*Seventh* Day of *July 1981*

[SEAL]

*Attest:*

RENE D. TEGTMEYER

*Attesting Officer*

*Acting Commissioner of Patents and Trademarks*